US007563134B2

(12) United States Patent
Kim

(10) Patent No.: US 7,563,134 B2
(45) Date of Patent: Jul. 21, 2009

(54) COAXIAL CABLE CONNECTOR

(75) Inventor: Il Kim, Osan (KR)

(73) Assignees: Hyundai Motor Company, Seoul (KR); Kia Motor Company, Seoul (KR)

( * ) Notice: Subject to any disclaimer, the term of this patent is extended or adjusted under 35 U.S.C. 154(b) by 0 days.

(21) Appl. No.: 12/082,172

(22) Filed: Apr. 8, 2008

(65) Prior Publication Data

US 2009/0011637 A1 Jan. 8, 2009

(51) Int. Cl.
*H01R 13/514* (2006.01)

(52) U.S. Cl. ..... 439/578; 439/752; 439/595; 439/567; 439/733.1

(58) Field of Classification Search ..... 439/578, 439/752, 595, 567, 733.1, 579–585, 57, 571
See application file for complete search history.

(56) References Cited

U.S. PATENT DOCUMENTS 3,845,453 A * 10/1974 Hemmer ..... 439/578
3,941,444 A * 3/1976 Bruni et al. ..... 439/587
5,624,278 A * 4/1997 Kuroda et al. ..... 439/675
6,902,416 B2 * 6/2005 Feldman ..... 439/219
7,226,320 B2 * 6/2007 Abe et al. ..... 439/668

* cited by examiner

*Primary Examiner*—Gary F. Paumen
(74) *Attorney, Agent, or Firm*—Edwards Angell Palmer & Dodge LLP; Peter F. Corless

(57) ABSTRACT

A coaxial cable connector connects coaxial cables with each other is disclosed. The coaxial cable connector includes a tap terminal, a tap housing, a tap locking member, a receptacle housing, a receptacle terminal and a receptacle locking member. The tap terminal is connected to a first coaxial cable, and has a locking groove. The tap housing includes a protrusion fixedly held in the locking groove, and the tap terminal is inserted into the tap housing. The tap locking member is mounted on the tap housing to hold the tap terminal that is inserted into the tap housing. The receptacle housing is detachably coupled with the tap housing, and the receptacle terminal is inserted into the receptacle housing and connects the tap terminal with a second coaxial cable. The receptacle locking member is mounted on the receptacle housing to hold the receptacle terminal that is inserted into the receptacle housing.

4 Claims, 2 Drawing Sheets

COAXIAL CABLE CONNECTOR

CROSS-REFERENCE TO RELATED APPLICATIONS

This application claims priority to Korean Application No. 10-2007-0068222, filed on Jul. 6, 2007, the entire disclosure of which is incorporated herein by reference.

BACKGROUND

1. Technical Field

The present invention relates to a coaxial cable connector which can tightly couple one coaxial cable with another in a manner such that the coaxial cables can be efficiently disposed in a limited interior space in a vehicle.

2. Background Art

Radio Frequency (RF) coaxial cables are used in various vehicle appliances, such as a Global Positioning System (GPS), a car audio system, a mobile phone, an air bag system, a communication wiring extension, an integrated antenna, an amplifier unit, an antenna amplifier and a multimedia device.

However, small shocks consecutively applied to the coaxial cables degrade the fastening force between connectors, each of which is connected to a respective coaxial cable. Accordingly, an advanced structure capable of maintaining a stable connection between the connectors is needed.

The information disclosed in this Background section is only for enhancement of understanding of the background of the invention and should not be taken as an acknowledgement or any form of suggestion that this information forms the prior art that is already known to a person skilled in the art.

SUMMARY OF THE DISCLOSURE

The present invention has been made to solve the foregoing problem with the prior art, and one object of the present invention is to provide a coaxial cable connector which can tightly couple one coaxial cable with another, so that the coaxial cables can be efficiently disposed in a limited interior space in a vehicle.

According to an aspect of the present invention, the coaxial cable connector includes a tap terminal, a tap housing, a tap locking member, a receptacle housing, a receptacle terminal and a receptacle locking member, whereby first and second coaxial cables are connected with each other. The tap terminal is connected to the first coaxial cable, and has a locking groove therein. The tap housing has a protrusion fixedly holding the locking groove, and the tap terminal is inserted into the tap housing. The tap locking member is mounted on the tap housing to hold one end of the tap terminal, which is inserted into the tap housing. The receptacle housing is detachably coupled with the tap housing, and the receptacle terminal is inserted into the receptacle housing and connects the tap terminal with the second coaxial cable. The receptacle locking member is mounted on the receptacle housing to hold one end of the receptacle terminal, which is inserted into the receptacle housing.

In a preferred embodiment, the tap locking member has a tap holding recess, which holds the inserted end of the tap terminal when the tap locking member is vertically inserted into the tap housing, and the receptacle locking member has a receptacle holding recess, which holds the inserted end of the receptacle terminal when the receptacle locking member is vertically inserted into the receptacle housing. The tap housing has a fixing recess engaging with one end of the tap locking member, which is inserted into the tap housing, and the receptacle housing has fixing recesses on both sides thereof, the fixing recesses in the receptacle housing engaging with an end of the receptacle locking member, which is inserted into the receptacle housing. The tap housing has a clip locking groove in the outer surface thereof, so that a separate fixing clip can be inserted into the clip locking groove. The coaxial tap housing and/or the receptacle housing has an anti-slip recess, to which tape is applied.

In another preferred embodiment, the tap housing and the receptacle housing are provided to double lock each of the tap terminal and the receptacle terminal, to which the coaxial cables are connected, in order to prevent the tap or receptacle terminals from being detached from the tap or receptacle housing by external force.

Accordingly, the present invention has a benefit in that the coaxial cables can be tightly coupled with each other. Furthermore, the connector of the present invention can be fixed to a vehicle body by a fixing clip, so that the coaxial cables can be efficiently disposed in the limited interior space in a vehicle.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like.

Other features of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration, and thus are not limitative of the present invention, and wherein.

Figure 1:
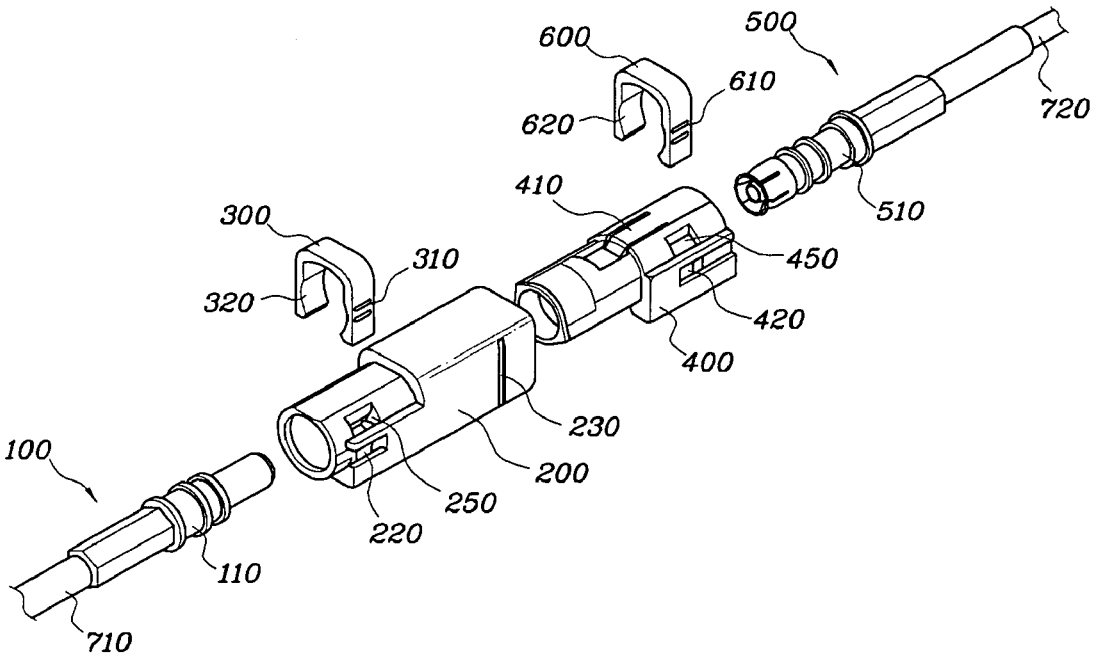
FIG. 1 is an exploded perspective view illustrating a coaxial cable connector of a preferred embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to preferred embodiments of the present invention, an example of which is illustrated in the accompanying drawings and described below. While the invention will be described in conjunction with an exemplary embodiment, it should be understood that the description is not intended to limit the invention to the exemplary embodiment. On the contrary, the invention is intended to cover not only the exemplary embodiment(s), but also various alternatives, modifications, equivalents and other embodiments, which may be included within the spirit and scope of the invention as defined by the appended claims.

Figure 2:
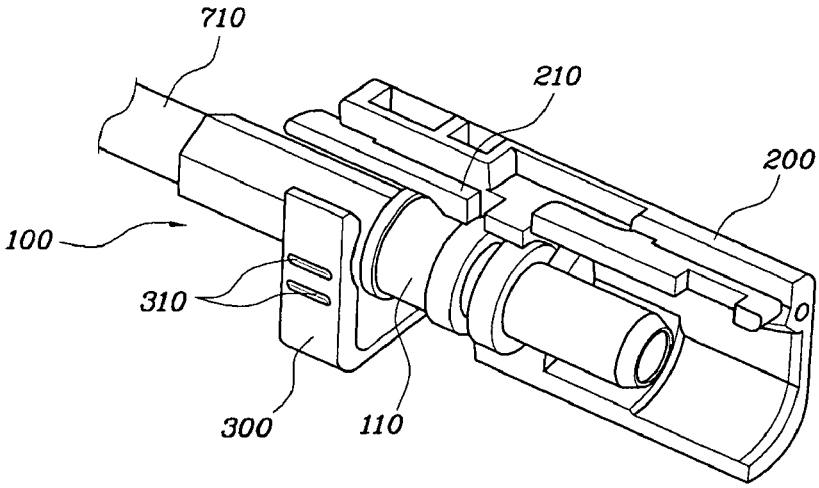
FIG. 2 is a enlarged cutaway perspective view illustrating a part of the coaxial cable connector of a preferred embodiment of the present invention.

As shown in FIGS. 1 and 2, a preferred embodiment of the present invention provides a coaxial cable connector in which a tap terminal 100 and a receptacle terminal 500 are connected to coaxial cables 710 and 720, and are double-locked through a tap housing 200 and a receptacle housing 400.

Specifically, the coaxial cable connector includes the tap terminal 100 connected to the coaxial cable 710, the tap housing 200, which holds the tap terminal 100 inserted thereinto, a tap locking member 300, which is vertically inserted into the tap housing 200 to hold the tap terminal 100, the receptacle terminal 500 connected to the coaxial cable 720, the receptacle housing 400, which holds the receptacle terminal 500 inserted thereinto and is detachably coupled with the tap housing 200, and a receptacle locking member 600, which holds the receptacle terminal 500.

According to an exemplary embodiment of the present invention, the tap terminal 100 is connected, at one end thereof, to the coaxial cable 710 and, at the other end thereof, to the tap housing 200. The tap terminal 100 has a locking groove 110 in an outer circumference thereof, which is held by the tap housing 200.

The tap housing 200 is a hollow connecting member, which is fixedly connected, at one end thereof, to the tap terminal 100 and, at the other end, to the receptacle housing 400. In an inner portion of the tap housing 200, a protrusion 210 is formed to hold the locking groove 110 of the tap terminal 100 when the tap terminal 100 is inserted into the tap housing.

In upper portions of the tap housing 200, which are opposite to each other, insert holes 250 are formed so that the tap locking member 300 is vertically inserted into the tap housing 200 through the insert holes 250. Fixing recesses 220 are formed in both sides of the tap housing 200 to fix the tap locking member 300 inserted into the tap housing 200. Specifically, the fixing groove 220 fixedly holds tap protrusions 310 of the tap locking member 300, which will be described later.

The tap locking member 300 functions to hold both sides of the inserted end of the tap terminal 100, and is in the shape of a ring that is open at the bottom. The tap locking member 300 is vertically inserted into the tap housing 200 through the insert holes 250 in the tap housing 200. The tap locking member 300 does not protrude from the outer surface of the tap housing 200, and thus the size of the connector can be minimized.

Particularly, the tap protrusions 310 are formed on both sides of the tap locking member 300, and are fixed to the fixing recesses 220 of the tap housing 200 when the tap locking member 300 is inserted into the tap housing 200. Tap holding recesses 320 are formed in an inner surface of both branches of the tap locking member 300. The tap holding recesses 320 are shaped so as to closely contact both sides of the insert end of the tap terminal 100.

When the tap terminal 100 is inserted into the tap housing 200, the tap terminal 100 is firstly held by the protrusion 210 of the tap housing 200, and is secondly held by the tap holding recesses 320 of the tap locking member 300. In this fashion, the tap terminal 100 can be tightly coupled with the tap housing 200. As a result, this structure can prevent the tap terminal 100 from being detached from the tap housing 200 by external force.

The receptacle terminal 500 is connected to the receptacle housing 400 at one end thereof and to the coaxial cable 720 at the other end thereof. A locking groove 510 is formed in an outer circumference of the receptacle terminal 500, and the receptacle housing 400 holds the locking groove 510 to engage with the receptacle terminal 500.

The receptacle housing 400 is a hollow connector member, which is connected at one end thereof to the receptacle terminal 500 and at the other end thereof to the tap housing 200. The receptacle housing 400 has a protrusion (not shown) for holding the locking groove 510 of the receptacle terminal 500 when the receptacle terminal 500 is inserted into the receptacle housing 400. While the protrusion of the receptacle housing 400 is not illustrated in the drawings, it is configured so that it is the same as the protrusion 210 of the tap housing 200.

On the top portion of the receptacle housing 400, an elastic piece 410 is provided so that the receptacle housing 400 can be detachably coupled with the tap housing 200. The elastic piece 410 acts to restrain the receptacle housing 400 to the tap housing 200 when the receptacle housing 400 is placed inside the tap housing 200 and is coupled therewith.

Insert holes 450 are formed in both sides of the upper portion of the receptacle housing 400, so that the receptacle locking member 600 can be vertically inserted into the receptacle housing 400 through the insert holes 450. In both sides of the receptacle housing 400, fixing recesses 420 are formed so that the receptacle locking member 600 can be inserted therein and thus fixed to the receptacle housing 400. Particularly, the fixing recesses 420 hold protrusions 610 of the receptacle locking member 600, which will be described later.

The receptacle locking member 600 functions to hold both sides of the insert end of the receptacle terminal 500, and is in the form of a ring having an opened bottom. The receptacle locking member 600 is vertically inserted into the receptacle housing 400 through the insert holes 450 in the receptacle housing 400. In this fashion, the receptacle locking member 600 does not protrude from the receptacle housing 400, and thus the size of the connector can be minimized.

Particularly, the protrusions 610 are formed on the outer surface of both sides of the receptacle locking member 600, and are fixed to the fixing recesses 420 of the receptacle housing 400 when the receptacle locking member 600 is inserted into the receptacle housing 400. Receptacle holding recesses 620 are formed in an inner surface of both branches of the receptacle locking member 600. The receptacle holding recesses 620 are shaped such that they closely contact both sides of the insert end of the receptacle terminal 500.

Accordingly, when the receptacle terminal 500 is inserted into the receptacle housing 400, the receptacle terminal 500 is firstly held by the protrusion of the receptacle housing 400, and is secondly held by the receptacle holding recesses 620 of the receptacle locking member 600. Thus, the receptacle terminal 500 can be tightly coupled with the receptacle housing 400. As a result, this structure can prevent the receptacle terminal 500 from being detached from the receptacle housing 400 by external force.

The coaxial cable connector of the above-described structure can be fixed to a vehicle body by taping or fixing clips.

Figure 3:
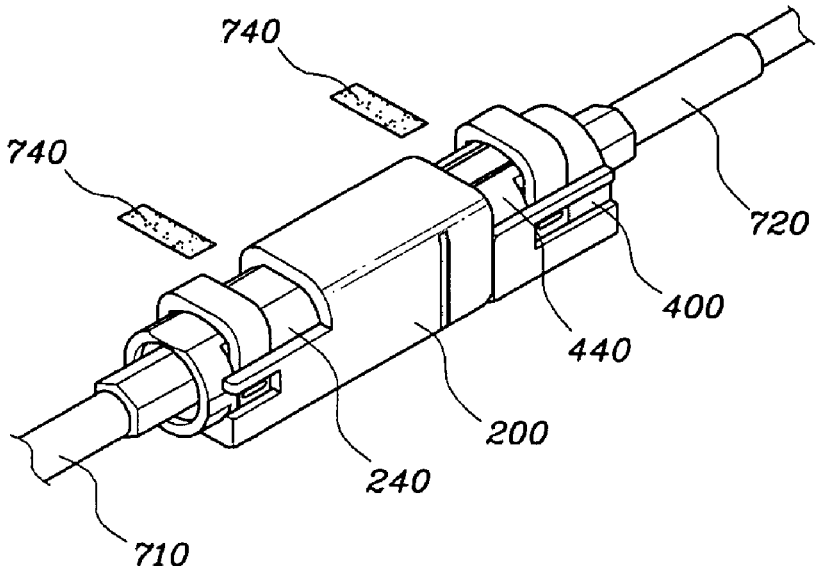
FIG. 3 is a perspective view illustrating the coaxial cable connector of a preferred embodiment of the present invention with tapes applied thereto.

As shown in FIG. 3, an anti-slip recess 240 is formed in an outer periphery of the tap housing 200, and an anti-slip recess 440 is formed in an outer periphery of the receptacle housing 400. The anti-slip recesses 240 and 440 can have tape 740 applied thereto to prevent slippage.

Figure 4:
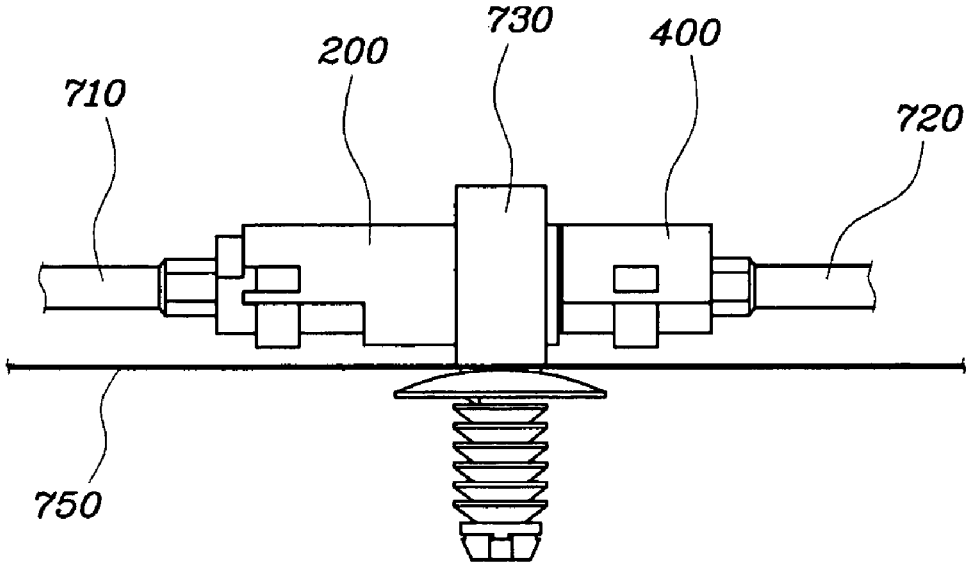
FIG. 4 is a front elevation view illustrating the coaxial cable connector of a preferred embodiment of the present invention with a fixing clip applied thereto.

A clip locking groove 230 is vertically formed in an outer surface of the tap housing 200. The clip locking groove 230 is in the form of a slit, so that a fixing clip 730 can be inserted thereinto, as shown in FIG. 4. When the connector of the present invention is fixed to a panel of a vehicle, the fixing clip 730 is fixedly inserted into the clip locking groove 230. Accordingly, the connector of the present invention can be coupled with the vehicle panel, and coaxial cables can be effectively disposed within a limited interior space in the vehicle.

While the present invention has been described with reference to the particular illustrative embodiments and the accompanying drawings, it is not to be limited thereto, but will be defined by the appended claims. It is to be appreciated that those skilled in the art can substitute, change or modify the embodiments in various forms without departing from the scope and spirit of the present invention.

What is claimed is:

1. A coaxial cable connector for connecting first and second coaxial cables with each other, comprising:

a tap terminal connected to the first coaxial cable, and having a locking groove;

a tap housing, into which the tap terminal is inserted, the tap housing having a protrusion that fixedly holds the locking groove;

a tap locking member mounted on the tap housing to hold an end of the tap terminal, which is inserted into the tap housing;

a receptacle housing detachably coupled with the tap housing;

a receptacle terminal inserted into the receptacle housing and connecting the tap terminal with the second coaxial cable; and a receptacle locking member mounted on the receptacle housing to hold an end of the receptacle terminal, which is inserted into the receptacle housing, wherein the tap housing includes a clip locking groove in an outer surface thereof, so that a separate fixing clip is inserted into the clip locking groove.

2. The coaxial cable connector according to claim 1, wherein the tap locking member includes a tap holding recess, which holds the inserted end of the tap terminal when the tap locking member is vertically inserted into the tap housing, and the receptacle locking member includes a receptacle holding recess, which holds the inserted end of the receptacle terminal when the receptacle locking member is vertically inserted into the receptacle housing.

3. The coaxial cable connector according to claim 2, wherein the tap housing includes a fixing recess, which engages with an end of the tap locking member that is inserted into the tap housing, and the receptacle housing includes fixing recesses in both sides thereof, the fixing recesses of the receptacle housing engaging with an end of the receptacle locking member that is inserted into the receptacle housing.

4. The coaxial cable connector according to claim 1, wherein the tap housing and/or the receptacle housing includes an anti-slip recess, to which a tape is applied.

* * * * *